US006375455B2

(12) United States Patent
Frandsen et al.

(10) Patent No.: US 6,375,455 B2
(45) **Date of Patent: *Apr. 23, 2002**

(54) INDEFINITELY REUSABLE CANDLE

(76) Inventors: Sue C. Frandsen, 9403 Leaside, Dallas, TX (US) 75238; Lawrence J. Murphy, 2215 Victoria La., Richardson, TX (US) 75082; Sherrilyn K. Rose, 2005 Pheasant Dr., Lewisville, TX (US) 75077

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/373,899

(22) Filed: Aug. 12, 1999

Related U.S. Application Data

(63) Continuation-in-part of application No. 08/943,437, filed on Oct. 3, 1997, now Pat. No. 6,036,477.

(51) Int. Cl.[7] ..... F23D 3/16

(52) U.S. Cl. ..... 431/289; 431/291; 431/126; 362/161

(58) Field of Search ..... 431/289, 288, 431/291, 292, 295, 296, 297, 125, 126, 320; D26/6, 9, 10, 13, 23; 425/803; 362/161; 264/271.1

(56) References Cited

U.S. PATENT DOCUMENTS

| | | | | | |
|---|---|---|---|---|---|
| 2,345,343 | A | | 7/1944 | Webber et al. | 431/289 |
| 2,481,019 | A | | 9/1949 | Joyce | |
| 2,713,256 | A | | 7/1955 | Oesteret | 431/292 |
| 2,974,509 | A | | 3/1961 | Penke | |
| 3,495,924 | A | * | 2/1970 | Doering et al. | 431/291 |
| 3,741,711 | A | | 6/1973 | Bryant | 431/125 |
| 3,806,723 | A | | 4/1974 | Ollom | 431/289 |
| 3,890,085 | A | * | 6/1975 | Andeweg | 431/289 |
| 3,898,039 | A | | 8/1975 | Lin | 431/288 |
| 4,568,270 | A | | 2/1986 | Marcus et al. | 431/288 |
| 4,755,135 | A | * | 7/1988 | Kwok | 431/291 |
| 4,805,076 | A | * | 2/1989 | Menter | 431/320 |
| 5,012,393 | A | * | 4/1991 | Knipe et al. | 431/291 |
| 5,395,233 | A | * | 3/1995 | Karp | 431/289 |
| 5,597,300 | A | | 1/1997 | Wohl et al. | 431/288 |
| 5,651,669 | A | * | 7/1997 | Henry | 431/289 |
| 5,690,484 | A | * | 11/1997 | Leonard et al. | 431/289 |

FOREIGN PATENT DOCUMENTS

| | | | |
|---|---|---|---|
| DE | 24 09 507 | * | 9/1975 |
| DE | 26 56 286 | * | 6/1978 |
| EP | 0 675 320 | * | 10/1994 |

* cited by examiner

*Primary Examiner*—Ira S. Lazarus
*Assistant Examiner*—Josiah C. Cocks
(74) *Attorney, Agent, or Firm*—Fulbright & Jaworski L.L.P.

(57) ABSTRACT

The invention relates to an indefinitely reusable composite construction candle having a substantially permanent cylindrical outer shell which is preferably made of wax within which is positioned a cylindrical insulating sleeve which is attached to the outer shell and which preferably provides thermal insulation between the outer shell and heat from the candle flame. A removable insert is placed within both the sleeve and outer shell which contains a wick and wax, or other combustible material, which is consumed during the candle burning operation. When the combustible material in the insert is depleted, the insert is replaced with another similar insert enabling the rest of the composite construction candle to remain unaltered. The invention provides for the ability to adjust both the height of the removable insert and the relative position of the insert with respect to the outer shell. The candle presents to the casual viewer the impression of a traditional candle of monolithic construction.

28 Claims, 3 Drawing Sheets

INDEFINITELY REUSABLE CANDLE

RELATED APPLICATIONS

The present application is a continuation in part of U.S. patent application Ser. No. 08/943,437, filed Oct. 3, 1997, which issued on Mar. 14, 2000, as U.S. Pat. No. 6,036,477, which is hereby incorporated herein by reference.

TECHNICAL FIELD

The invention relates in general to chandlery and in particular to reusable candles.

BACKGROUND

The fabrication and burning of large candles generally present a number of problems in the prior art. One such problem is that of guttering. Guttering refers to a process in which a pool of hot wax near the flame melts a channel in the surrounding wax. Such guttering may cause the available pool of molten wax to dissipate thereby causing the wick to stop burning. Further, the flow of molten wax into the surrounding wax may disfigure the candle by melting surrounding wax which serves to provide structural support for other portions of the candle. Guttering may present a fire hazard by enabling molten wax to escape the confines of the candle and contact flammable materials external to the candle itself Aside from the risk of fire, once a candle has been disfigured by guttering, an additional problem is that a large proportion of the wax in the original candle cannot be productively burned and therefore goes to waste.

The fire hazard may be exacerbated where potpourri candles (candles incorporating herbs or leaves to add selected odors) are concerned since the added material may increase the overall flammability of the candle.

Prior attempts to address the problem of guttering have generally been unsuccessful. One approach has been to use candles having inner and outer wax shells with different melting points. Using such a configuration, the outer shell preferably has a higher melting point than the inner shell to prevent guttering from affecting the outer shell. Generally however, the difference between the inner and outer shell melting points is not sufficient to prevent guttering from affecting the outer shell. Once guttering does reach the outer shell, the problems arising from such guttering are similar to those discussed above.

A second approach involves employing concentric outer and inner wax portions separated by a cylinder of insulating material. Generally, this approach involves having the inner wax portion burn all the way down to its base while the insulating material prevents the heat from disrupting the outer wax portion. It is desired that the inner wax portion would thereby burn all the way to the base and leave the insulating material and outer wax portion intact. If guttering is in fact avoided in this insulated design, the inner wax portion will experience difficulty burning near its own base due to a shortage of oxygen. Generally, as the inner wax portion nears the base of the candle structure because of continued burning, preservation of the flame will be rendered difficult because of an insufficient supply of oxygen, an inability to preserve a molten state of the wax near the burning portion of the wick, or a combination of the two stated factors.

That wax in the inner portion which is not burned as a result of the factors recited above is wasted which is an undesirable characteristic of the prior art. Further, the remaining components of the original candle cannot readily be reused. The unused wax at the bottom of the inner wax portion, or wax core, prevents consumers from simply purchasing "inserts" or substitute wicked wax cores for insertion into the insulated outer shell. It is a problem in the prior art that the unburned portions of composite construction candles cannot be readily reused.

Another approach to the problem of guttering involves the use of a glass wall accompanied by a thermal insulator between inner and outer wax portions. This approach generally reduces guttering and provides for some degree of reusability. While this approach may reduce guttering, the resulting device is made expensive, heavy, and fragile because of the addition of glass to the design. The fragility of the glass can of course result in breakage of the glass due to mechanical stresses from being dropped or hit. Further, the glass can crack because of repeated heating and cooling operations to which it will be subjected in successive candle burnings within the inner core.

Therefore, it is a problem in the art that guttering may render large candles unusable by causing the candle structure to deteriorate.

It is a further problem in the art that guttering causes a large proportion of the wax in a large candle to be wasted.

It is a still further problem in the art that guttering may present a fire hazard by placing molten wax in contact with flammable materials.

It is a still further problem in the art that composite construction candles employing waxes with different melting points result in a substantial proportion of the wax being wasted.

It is a still further problem in the art that composite construction candles employing waxes with different melting points are generally not reusable.

It is a still further problem in the art that composite construction candles employing glass to separate wax sections of the candle are generally heavy, expensive, and fragile.

It is a still further problem in the art that glass used to separate wax sections in a composite construction candle is subject to cracking when subjected to a succession of candle burnings and associated cooling off periods.

SUMMARY OF THE INVENTION

These and other objects, features and technical advantages are achieved by a system and method which incorporates an indefinitely refillable candle preferably including a cylindrical outer shell, an inner sleeve, or insulating layer, attached to the outer shell, and a removable insert containing a wicked candle component to be burned. The composite construction preferably includes recesses and dimensions which are adjusted so as to present the outward impression of a candle of monolithic construction.

In preferred embodiment of the present invention, the outer shell is made of wax to aid in presenting an image of a monolithic wax candle to a consumer or other person viewing the candle. Alternatively however, other materials could be used for the cylindrical outer shell. This is particularly true in the present invention since the outer shell preferably does not burn during operation of the candle. Further, the outer shell need not be cylindrical but may be constructed in a variety of different shapes and sizes wherein all such shapes and sizes are intended to be included within the scope of the present invention.

In a preferred embodiment of the present invention, the sleeve is preferably cylindrical and constructed so that its outside diameter will correspond to the inner diameter of the outer shell. The sleeve is preferably constructed of a material with low thermal conductivity so as to prevent heat from the burning wick and wax from melting wax or other material in the outer shell portion of the candle. The material used for the sleeve is also preferably of lightweight construction so as to help minimize the weight of the composite candle assembly.

In a preferred embodiment of the present invention, the removable insert includes a cup having a cylindrical side wall and a base and containing wax and a wick which is substantially centrally located within the cup. The cup is preferably constructed of a thin, light, flexible, and thermally insulating material so as to minimize the transmission of heat from the burning wax toward the sleeve and the outer shell of the candle. Lexan™ is one preferred material for the cup. However, other plastics and non-plastic materials may be used and all such other materials are intended to be within the scope of the present invention.

In a preferred embodiment of the present invention, the insert is secured to the sleeve by including a flange along the exterior of the preferably cylindrical cup sidewall which enables the cup to be suspended at a selectable height with respect to the sidewall and outer shell. The flange preferably rests on the upper edge of the preferably cylindrical sleeve. The insert may alternatively be supported by other means and all such support means are intended to be within the scope of the present invention.

The deployment of the above described sleeve, insert materials, with their thermally insulating properties prevent the guttering present in the prior art and the transmission of heat sufficient to melt the outer shell of the candle. The prevention of guttering preferably prevents the problems caused by guttering including but not limited to: structural disabling of the candle, cessation of the flame due a lack of molten wax, and the creation of a possible fire hazard.

In a preferred embodiment of the present invention, the wax in the removable insert is substantially completely burned thereby reducing waste, providing for longer burning time, and generally providing more efficient operation of the candle.

Therefore, it is an advantage of an embodiment of the present invention that guttering is avoided thereby preventing such problems as structural destruction of the candle, and cessation of the candle flame.

It is a further advantage of an embodiment of the present invention that insulating materials employed in the removable insert and the sleeve prevent transmission of heat sufficient to melt or harm the outer shell of the candle.

It is a still further advantage of an embodiment of the present invention that the candle is reusable by replacing the removable insert.

It is a still further advantage of an embodiment of the present invention that the sleeve and the cup portion of the insert are composed of resilient materials which will not readily break due to exposure to mechanical impact or exposure to successive periods of heating and cooling.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
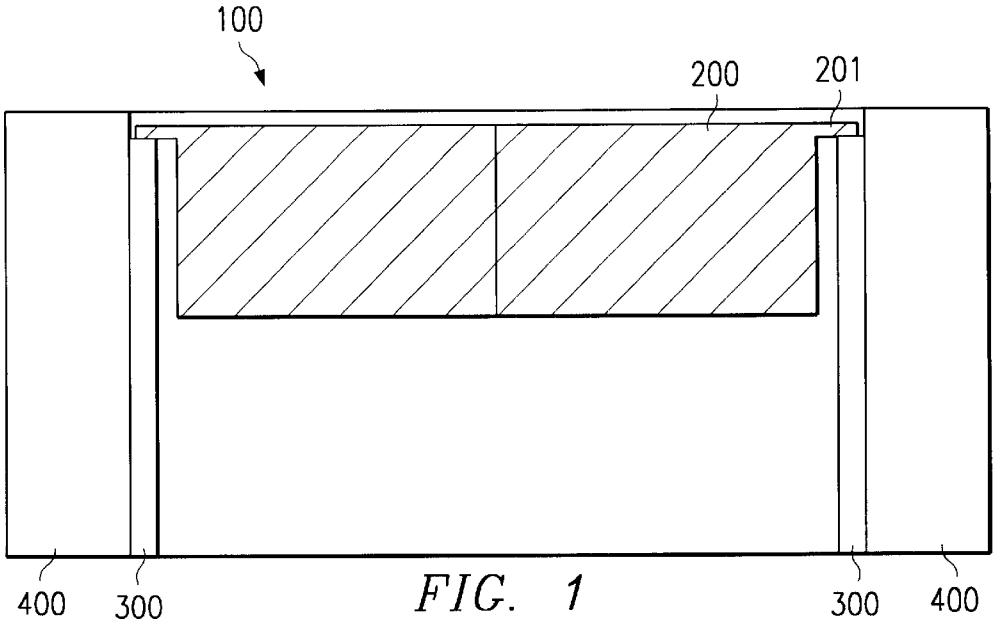
FIG. 1 is a section view of a composite construction candle according to preferred embodiment of the present invention.

FIG. 1 depicts a composite construction candle 100 according to preferred embodiment of the present invention. An outer portion or outer shell 400 which is preferably cylindrical in shape forms the external structure of the candle 100. The outer shell is preferably made of wax to aid in conveying an impression to a consumer that the assembly is a monolithic wax candle. Alternatively however, the outer shell 400 could be made of a variety of materials and all such materials are intended to be within the scope of the present invention.

The outer shell 400 is generally not consumed in the burning process but rather serves as a substantially permanent structure into which removable inserts 200 are placed for burning purposes. Although the outer shell 400 is preferably cylindrical, a variety of cross-sectional geometries could be employed and all such geometries are within the scope of the present invention.

Preferably, sleeve 300 is attached to outer shell 400 along the entire circumference of the inner surface and along substantially all of the height of outer shell 400. The sleeve thereby preferably acts to insulate the outer shell 400 from heat generated by combustion within removable insert 200. Sleeve 300 may be recessed slightly from the top of the candle 100 and therefore rise to a slightly lower height than outer shell 400. This recess preferably allows a flange 201 which is part of removable insert 200 to rest on the top of sleeve 300 and still permit the top of the flange to remain flush with the top of the outer shell 400 thereby enabling the top of the candle 100 to have a substantially even and smooth surface across the top of candle 100.

The sleeve 300 preferably closely follows the shape of the outer shell 400 to which it is preferably fixedly attached. As with the outer shell 400, the sleeve therefore preferably has a substantially cylindrical cross sectional geometry. Alternatively, the sleeve 300 could have a variety of cross sectional geometries with each such geometry preferably matching the geometry of the outer shell 400 to which it is attached.

In a preferred embodiment of the present invention, the combustible material is included within a removable insert 200 which is preferably placed on the top surface of the sleeve 300. The upper surface of the insert 200 is preferably flush with the upper surface of the outer shell 400. Alternatively however, the insert 200 could be suspended such that its upper surface is at a variety of possible vertical positions along the height of the sleeve 300 and outer shell 400 and all such possible locations for the removable insert are intended to be within the scope of the present invention.

The insert 200 is preferably substantially shorter in the vertical dimension than the height of the sleeve 300 and of outer shell 400. Limiting the depth of the insert 200 with respect to the upper edge of the sleeve 300 and outer shell 400 is desirable because combustion becomes more difficult at greater depths. Alternatively however, the height of the insert 200 could be considerably increased even to the point of equaling the height of the outer shell 400. All possible lengths of the insert 200 are intended to be within the scope of the present invention.

In a preferred embodiment, a felt pad may be added to the bottom surface of the assembly of the sleeve 300 and outer shell 400 to serve as a base. Alternatively, other base materials may be employed to serve in place of felt.

Figure 2:
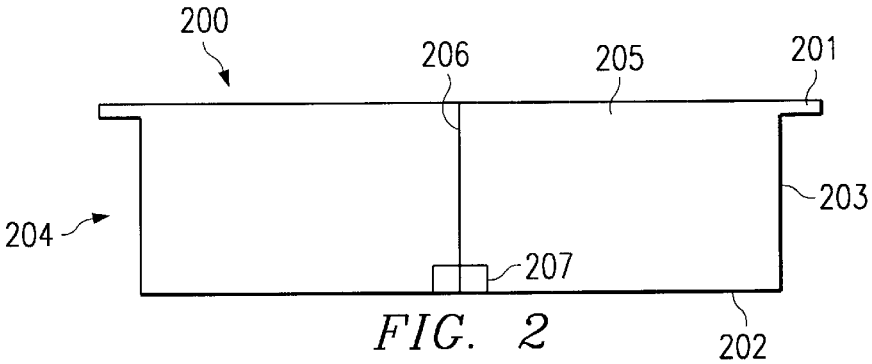
FIG. 2 is a section view of a removable insert for use in a candle according to a preferred embodiment of the present invention.

FIG. 2 depicts a section view of a removable insert 200 for use in a candle 100 according to a preferred embodiment of the present invention. The removable insert includes cup 204, combustible material 205, and wick 206. The combustible material 205 is preferably wax. Alternatively, a number of other combustible materials could be used and all such alternative materials are intended to be within the scope of the present invention.

The cup 204 is preferably substantially in the shape of a square with an open top and has a base 202, a side of substantially cylindrical cross-sectional geometry 203, and flange 201. Further, the flange 201 is a substantially circular disk portion in a preferred embodiment. The flange 201 preferably serves to enable the removable insert 200 to be supported by the sleeve 300 by placing the removable insert into the hollow center of the sleeve 300 such that the flange 201 contacts the top of the sleeve. The removable insert 200 is preferably concentric with respect the preferably cylindrical sleeve 300 and the substantially cylindrical outer shell 400.

The wick 206 is preferably of standard design which is well known in the art and will therefore not be discussed in detail in the present application.

In a preferred embodiment, the cup 204 will have a diameter of about 4 inches and a height of 1.5 inches. Alternatively, a range of dimensions for all of the height, diameter, and thickness are available and all such dimensions are intended to be within the scope of the present invention. A preferred material for construction of the cup is Lexan™. Alternatively however, a range of other materials, both plastic and non-plastic, may be employed and all such materials are intended to be within the scope of the present invention. Preferably the cup 204 will be composed of a material which is light, flexible, and which has both a high melting point and a high ignition point so as to prevent the cup from either burning or melting when exposed to the heat of the candle flame.

In a preferred embodiment of the present invention, molding of the combustible material 205 inside insert 200 is performed separately from the molding of the outer shell 400. Preferably, the combustible material 205 is poured into cup 204 up to a desired level. The molding of the combustible material 205 may be performed in a single pouring operation or by using a succession of pouring operations, in each case waiting for previously poured material to sufficiently cool down before initiating a subsequent pouring operation.

In a preferred embodiment of the present invention, once the combustible material 205 in the insert 200 has been depleted, the empty insert 200 is removed from the outer shell/sleeve assembly and a new insert 200 inserted in its place. The burning process may then begin anew preferably without any consumption or damage to the material of the sleeve 300 or outer shell 400.

In a preferred embodiment, appropriate selection of the diameter and depth of the cup 204 and the combustible material 205 contained in the cup leads to much improved combustion efficiency over the prior art. Preferably, in excess of 90% of the combustible material 205 present in a fresh insert 200 is consumed before the insert burns out. This represents a substantial improvement over the prior art. For example, in a single walled pillar candle around six inches tall, only about 25% of the weight of the wax in the candle is consumed through combustion before guttering occurs. In such a single walled pillar candle, generally, the percentage of the wax burned before guttering occurs tends to decrease as the height of the candle increases.

In addition to the improved combustion efficiency, the insert 200 is much lighter than prior art candle, of a size comparable to that of the composite construction candle 100. Accordingly, the- insert 200 can therefore be removed, replaced, moved around with much greater ease than could entire candles employing the technology of the prior art. Unless it is desired to move the candle 100 as a whole, there is generally no need to move the outer shell 400 and sleeve 300 when a first refill 200 burns out and a second refill is used to replace it.

In a preferred embodiment of the present invention, a wick 206 is anchored to a metal base 207 at the base of cup 204 to secure the wick during pouring of molten wax into the refill 200. In an alternative preferred embodiment, a plurality of wicks 206 could be used and all be connected to a single metal base 207. In another alternative preferred embodiment, a plurality of wicks 206 could be used with each wick being connected to a separate metal base 207. In yet another alternative embodiment, the metal base could be omitted. In other alternative embodiments, a non-metallic base could be employed.

Figure 5:
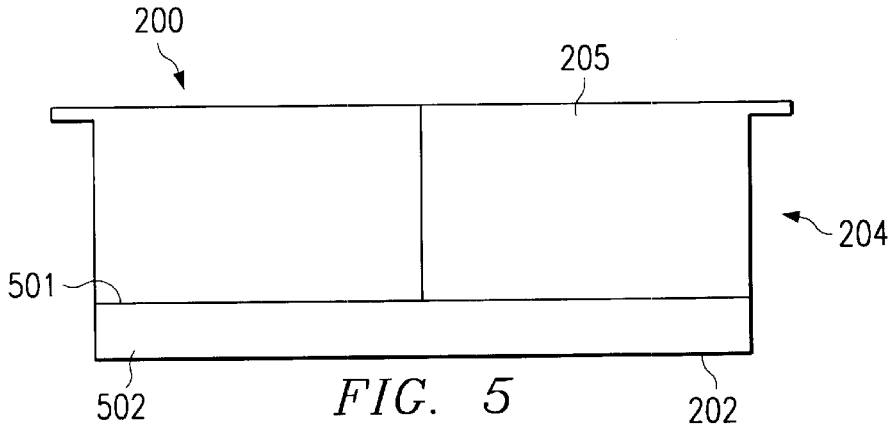
FIG. 5 is a section view of an insert employing a plastic base according to a preferred embodiment of the present invention.

FIG. 5 depicts a section view of an insert 200 employing a plastic base 501 according to a preferred embodiment of the present invention. In a preferred embodiment of the present invention, a disk 501 made of Teflon™ or other suitable plastic, or non-plastic thermally insulating material may be deployed within the insert 200. Preferably, the disk would have a hole in its center through which the wick would pass. The disk 208 may be used either with or without the use of a metal base 207 (FIG. 2). Preferably, the disk 501 would have a thickness of about 0.005 inches. Alternatively, the disk may have a range of thicknesses and all such thicknesses are within the scope of the present invention.

The disk 501 may be placed in contact with the base 202 of the cup 204 or alternatively may be raised some distance above the base 202. If present, the space 502 in between the bottom of the disk 208 and the base 202 of the cup 204 may be air or may alternatively be filled with combustible material whether wax or other matter.

In a preferred embodiment, deployment of the disk 501 helps keep the wick 206 oriented when the combustible material 205 is molten. The disk 501 may also help hide the metal base 208, if used, from view. Preferably, the disk 501 also acts to reduce the localized heating in the case where the wick 206 touches the base 202 of the cup 204. Reducing the locally generated heat lowers the stress on the cup 204, particularly where the cup is made of glass, thereby reducing the risk of cracking the cup and the attendant risk of fire.

Figure 3:
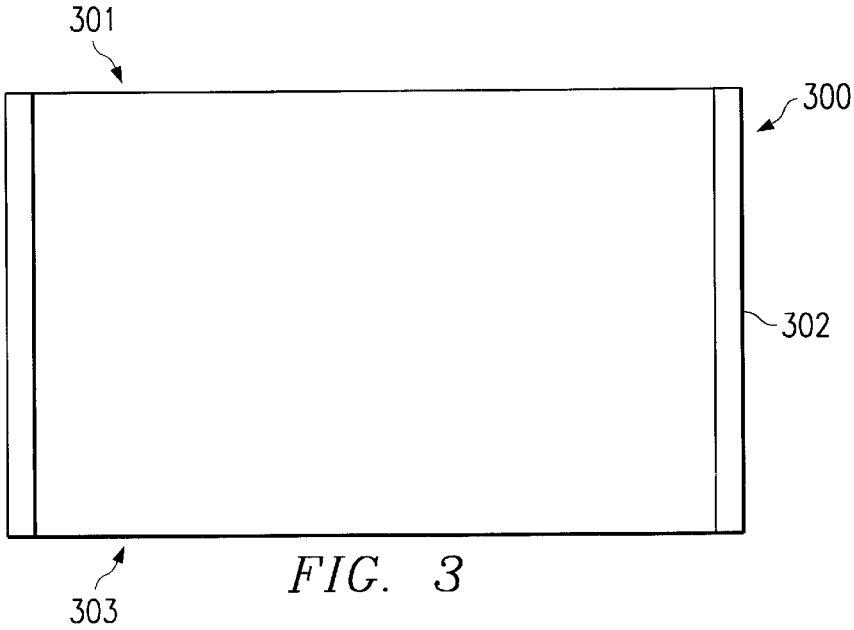
FIG. 3 is a section view of a sleeve for insertion into the outer shell of a candle according to a preferred embodiment of the present invention.

FIG. 3 depicts a sleeve 300 for insertion into the outer shell of the candle according to a preferred embodiment of the present invention. The sleeve 300 is preferably a cylinder whose height matches the height of the outer shell of the candle, with an internal diameter which is designed to be slightly larger than the outside diameter of the cup (FIG. 2) so as to enable the cup to fit inside the sleeve and preferably be suspended therefrom. The outside diameter of the sleeve 300 is preferably very slightly smaller than the internal diameter of the outer shell of the candle within which the sleeve is intended to fit. A preferred thickness for the side or wall 302 of the sleeve 300 is between 0.25 to 0.5 inches. Alternatively, a range of thicknesses both smaller and larger than the 0.25 to 0.5 inch range may be employed, and all such alternatives are considered to be within the scope of the present invention.

Preferably, both the top 301 and bottom 303 of the sleeve are unobstructed. Alternatively, the bottom 303 could include a base material rigidly attached to the sleeve and this alternative is intended to be within the scope of the invention. As an alternative to having a completely unobstructed top 301 of the sleeve 300, a mechanism for securing the cup 204 (FIG. 2) could be integrally incorporated into the sleeve 300. Such a mechanism could include but is not limited to a flexible tapered flange for centering and securing the cup and a radially inwardly directed flange for suspending a cup with a diameter which is substantially different from the internal diameter of the sleeve 300.

The sleeve 300 is preferably made of polyvinyl chloride (PVC) but alternatively may be composed of a range of other plastic or non-plastic materials, and all such alternative materials are intended to be within the scope of the present invention. It is desired that the sleeve 300 be a good thermal insulator and have both a high ignition point and a high melting point so as to avoid having the sleeve 300 either melt or burn when exposed to heat from combustion of material inside the insert 200.

In a preferred embodiment of the present invention, the sleeve 300 is adhered to the outer shell 400 by placing the sleeve 300 in a candle mold. Preferably, a tight seal would be created between the doughnut shaped bottom surface of the sleeve and a flat surface of the mold to prevent seepage of molten material past the sleeve/mold connection. The mold is preferably cylindrical and designed such that the inner diameter of the mold is substantially equal to the desired outer shell diameter. Creation of the outer shell 400 would then be accomplished by pouring molten material, preferably wax, into the doughnut shaped cavity between the exterior of the sleeve 300 and the interior of the cylindrical mold. Preferably, once the outer shell 400 material cools, the sleeve 300 is bonded to the outer shell 400 through the process of solidification of the molten material. Accordingly, the sleeve 300 and outer shell 400 to which the sleeve is fixedly attached can preferably be handled and treated as a single part.

Alternatively, the sleeve may be adhered to the outer shell employing a variety of means including but not limited to: a friction fit between the sleeve and the outer shell, gluing the sleeve 300 to the inner surface of the outer shell 400, and providing a pool of molten wax in the shape of a desired outer shell around the exterior of the sleeve, appropriately containing the pool of wax, and then congealing the wax thereby bonding the sleeve to the congealed wax outer shell.

Figure 6:
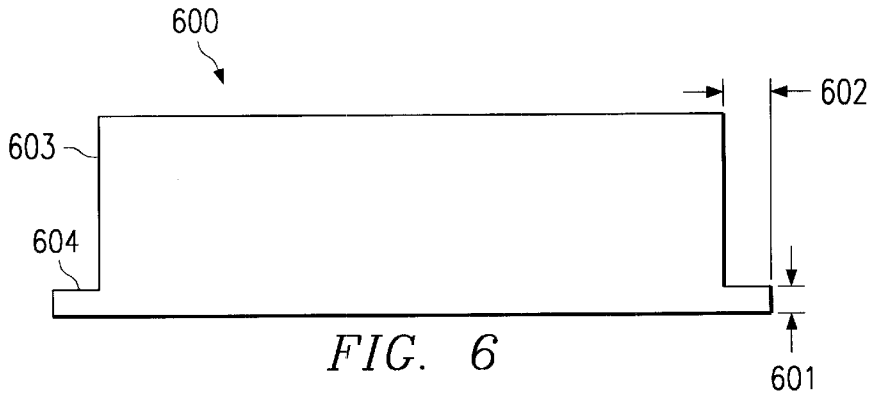
FIG. 6 depicts a step for use in displacing a sleeve from the base of a mold during production of an outer shell according to a preferred embodiment of the present invention.

FIG. 6 depicts a step for use in displacing a sleeve 300 from the base of a mold during production of an outer shell according to a preferred embodiment of the present invention. In a preferred embodiment of the present invention, a step 600 may be placed inside the sleeve 300 during the process of molding the outer shell 400 around the external surface of the sleeve 300 in order to raise the sleeve 300 from the bottom of the mold during creation of the outer shell 400. The distance by which the sleeve is raised during molding of the outer shell 400 becomes the depth of a recess once the sleeve/outer shell assembly is ready to be used in a candle 100.

Step 600 is preferably made of metal so as to enable the step 600 to be readily disengaged from the sleeve after molding of the outer shell 400 is complete. Alternatively, other materials could be used for the step 600 such as metal and ceramic, and all such variations are within the scope of the invention. Before the molding process begins, the edge of sleeve 300 is preferably seated on surface 604 with the inside diameter of the sleeve 300 contacting the outside surface 603 of the step 600.

In a preferred embodiment, once the sleeve is securely mounted on the step, the outside diameter of the sleeve 300 is flush with the widest outside diameter of the step 600. Preferably, the difference between the narrow and wide radii of the step 600 is equal to the thickness of the sleeve 300. In FIG. 6, element 602 represents this distance, which, in a preferred embodiment is ⅛ inch. Alternatively, a range of different sleeve thicknesses and corresponding compensating dimensions on the step 600 could be employed, and all such variations are within the scope of the invention.

In a preferred embodiment, the sleeve 300 is raised by a finite distance 601 by the step 600 during the molding process. This distance 601 is preferably 0.25 inches. Alternatively, the distance 601 could assume a range of different values, and all such values are within the scope of the invention.

Figure 7:
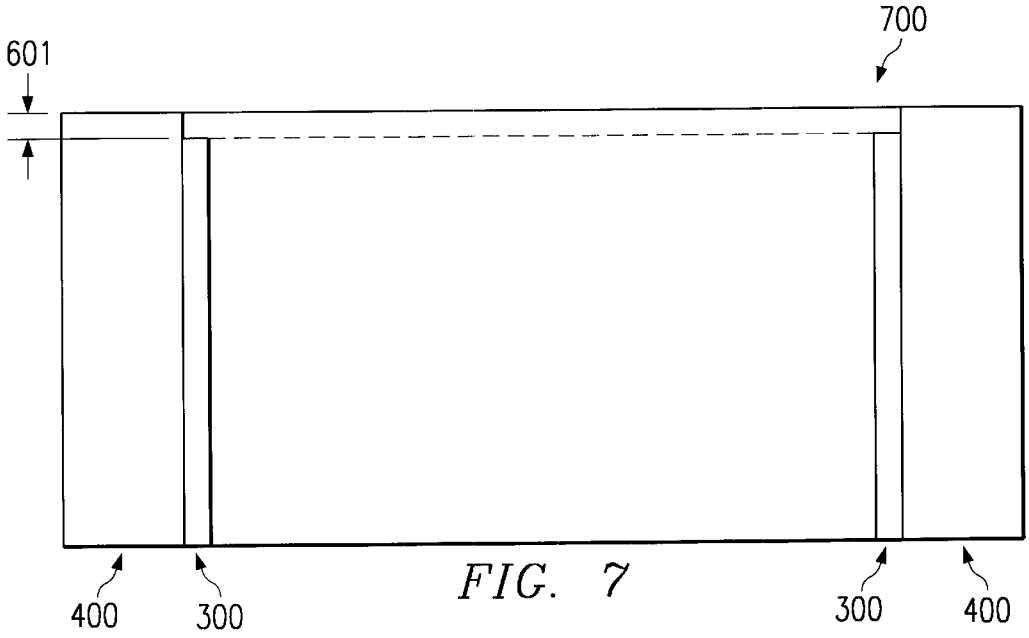
FIG. 7 depicts a sleeve recessed with respect to the top surface of the outer shell to which it is bonded according to a preferred embodiment of the present invention.

In a preferred embodiment, after the molding process, upon turning the sleeve-outer shell assembly upside down, the distance 601 by which the sleeve was raised in the molding process is preferably the distance 601 by which the top surface of the sleeve 300 is recessed with respect to the top surface of the outer shell 400 (see FIG. 7).

FIG. 7 depicts a sleeve 300 recessed with respect to the top surface of the outer shell 400 to which it is bonded according to a preferred embodiment of the present invention. In a preferred embodiment, the distance by which the sleeve 300 is recessed with respect to the outer shell 400 is determined by the pertinent dimension 601 of a step 600 used in the molding process. However, the invention is not limited to effecting a recess of the sleeve with respect to the outer shell employing the step 600 as discussed in connection with FIG. 6.

In a preferred embodiment, the recess distance 601 enables an insert 200 having a flange 201 (FIG. 2) to be placed on the upper edge of the sleeve 300 such the top surface of the insert is flush with the top surface of the outer shell 400.

In a preferred embodiment, the sleeve 300 is cylindrical, thereby having a circular cross-sectional geometry as viewed from above, so as to match the surface of the outer shell 400 to which it is bonded. However, the sleeve 300 may assume a number of other cross-sectional geometries as viewed from above in FIG. 3 in order the match the cross-sectional geometries of the insert 200 and the outer shell 400 and all such variations are within the scope of the invention.

In a preferred embodiment of the present invention, the outer shell 400 is made of wax and the sleeve 300 is helpful in providing both thermal and structural protection for the outer shell 400 thereby preventing the outer shell 400 from melting, burning, or guttering in reaction to heat from the candle flame. In an alternative embodiment, the outer shell may be composed of a number of other substances including but not limited to plastic, stone, metal, and ceramic. Where the outer shell 400 is composed of a material not in need of the thermal and structural protection provided by the sleeve 300 for a wax outer shell, the sleeve 300 may be omitted from the construction of the candle 100.

Figure 4:
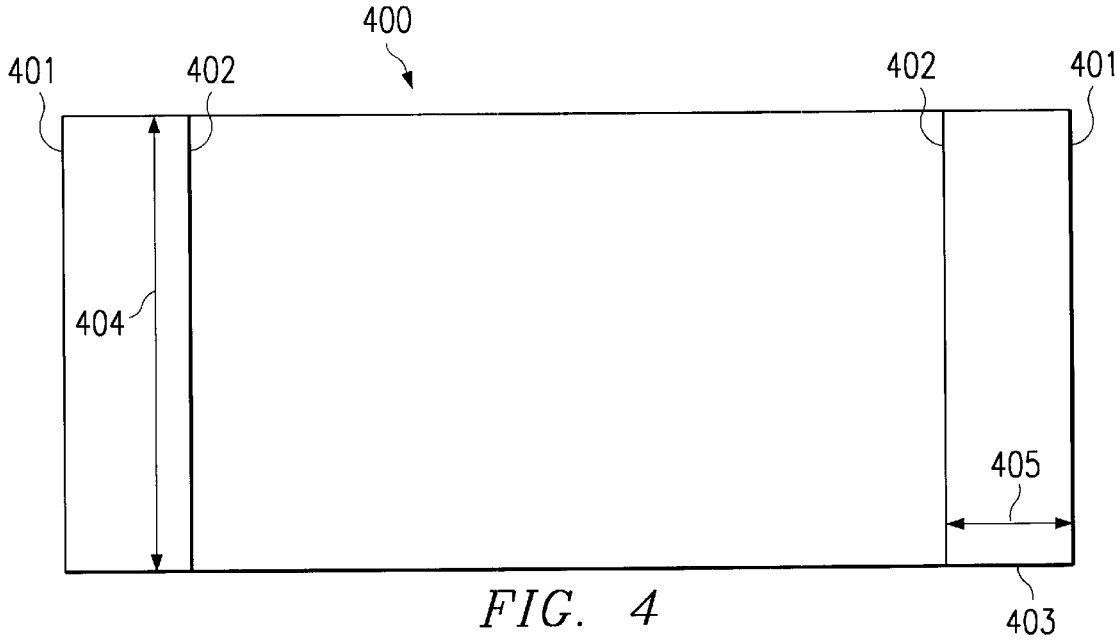
FIG. 4 is a section view of an outer shell of a candle according to a preferred embodiment of the present invention.

FIG. 4 depicts an outer shell 400 of the candle according to a preferred embodiment of the present invention.

In a preferred embodiment of the present invention, the outer shell 400 primarily serves a decorative and structural function in the operation of the composite construction candle 100. The material, preferably wax, of the outer shell 400 is preferably not consumed or significantly affected by the combustion of material inside the removable insert 200. Rather, the outer shell 400 and the sleeve 300 to which it is attached serve as a platform into which a removable insert 200 is inserted. It is the removable insert 200 which contains material 205 which is consumed during the candle 100 burning operation. Accordingly, although the outer shell 400 is preferably made of wax, a number of materials could be used without affecting the process of combustion within the candle 100 or of illumination emanating from the candle 100. All such materials are intended to be within the scope of the present invention.

Once material inside a removable insert 200 has been substantially completely consumed, the insert 200 is preferably removed and replaced with a new insert. This process preferably has the effect of making the outer shell 400 and sleeve 300 indefinitely reusable.

The outer shell 400 is preferably composed of wax. However, since the outer shell 400 primarily serves a decorative and structural purpose, numerous other materials could be substituted without adversely affecting the operation of the inventive candle. The alternatives include, but are not limited to: plastic, ceramic, metal, stone, and polymers. All such alternative materials are intended to be within the scope of the present invention.

In a preferred embodiment, the appearance and dimensions of the outer shell should be such as to present the impression of a monolithic candle structure to a casual viewer. Therefore, it is preferable that the top of the outer shell 400 be even in height with, or higher than the top of the flange 201 on the insert 200 such that the outer shell 400 is visible from most viewing angles.

In a preferred embodiment, the outer shell 400 is in the shape of a cylindrical ring with a hollow center when viewed from above. In the side section view of the preferred embodiment outer shell 400 in FIG. 4, the material 403 forming the shell 400 has a width 403 and a height 404. In an alternative embodiment, the outer shell need not be hollow in the center but could have a number of different geometric variations within the interior of the ring, including but not limited to: a solid base made of the same material as the rest of the outer shell. In other alternative embodiments, the outer shell need not have a circular cross-sectional geometry when viewed from above but may but may have a variety of other cross-sectional geometries (as viewed from above) including but not limited to: oval square, rectangular, and triangular and all such variations are included within the scope of the invention. Further, although the insert 200 (FIG. 2) is preferably of circular cross-sectional geometry as viewed from above in the view of FIG. 2, the insert may assume other cross-sectional geometries, as viewed from above, including but not limited to a: square, triangle, and star, and all such variations are within the scope of the invention. For the various possible insert 200 geometries, the portion of the outer shell 400 which contacts the insert 200 will, in each case, match the geometry of the insert 200.

The above described candle 100 provides numerous advantages over the prior art. Perfume may be placed in the outer shell 400. Although perfume could also be placed in the refill 200, the outer shell 400 remains in place essentially indefinitely while the contents of each refill 200 are burned up with each use. Considerable flexibility is added through the use of a removable insert 200 such as variation in the height and placement of the insert 200. Differences in the character of the illumination can be achieved by having the flame positioned at points substantially removed from a plane parallel to the top of the outer shell 400. The optimal location for the flame may depend on optical properties of the sleeve and outer shell as well as the setting in which the candle 100 is to be employed.

In a preferred embodiment, the risk of fire spreading beyond the candle is considerably reduced because, of the deployment of insulating material both in the cup 204 forming the outer portion of each removable insert 200 and in the sleeve 300.

In an preferred embodiment, various aesthetic options are available. The colors of the outer shell 400, the combustible material 205, and the cup 204 material may be varied independently to create a variety of possible illumination effects during combustion of the candle 100. Translucent material may be employed for the outer shell 400 enabling light from the burning wick to be transmitted throughout the body of the candle thereby producing one particular visual effect. Where the color of the outer shell 400 is substantially neutral, the color of the material 205 in the insert 200 may be varied to suit a variety of different occasions. Inserts 200 with different colors of combustible material 205 in them may be made available in advance and readily inserted into and removed from the candle 100 as circumstances warrant.

In a preferred embodiment, potpourri may be incorporated into the material of the outer shell 400 for decorative purposes and to add odor to the candle. The potpourri can include matter such as dried herbs, leaves, or other matter of plant origin. In the prior art such potpourri can worsen the risk of fire in the event that guttering occurs or if the outer shell is exposed to excessive heat from the flame. However, in a preferred embodiment of the present invention, various layers of thermally insulating material contribute to minimizing such a fire risk from the potpourri. Specifically, the cup 204 material as well as the sleeve 300 material act to insulate the outer shell 400 and any potpourri contained therein from the risk of fire due both to the prevention of guttering and to the provision of insulation from the heat of the candle flame.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A reusable candle of lightweight construction, the candle comprising:

an outer shell;

an insulating layer disposed within and in substantially continuous contact with said outer shell, wherein said outer shell and said insulating layer form a substantially permanent structure;

a removable insert including a cup composed of lightweight flexible material, wherein said cup has substantially fixed dimensions enabling said cup to fit snugly within said insulating layer, and wherein said insert is readily removable from said substantially permanent structure;

a wick and combustible material disposed within said cup; and a plastic disk in said removable insert to which said wick is secured, wherein said plastic disk is located near a base of said insert.

2. The reusable candle of claim 1 wherein said candle has a cylindrical cross-sectional geometry.

3. The reusable candle of claim 1 wherein said insulating layer is rigidly bonded to an interior surface of said outer shell.

4. The reusable candle of claim 1 wherein a bond between said insulating layer and said outer shell is achieved by melting and re-solidifying a portion of said outer shell while said insulating layer is in contact with said outer shell.

5. The reusable candle of claim 1 wherein said insulating layer is plastic.

6. The reusable candle of claim 1 wherein said insulating layer is polyvinyl-chloride.

7. The reusable candle of claim 1 wherein the cup is composed of polycarbonate.

8. The reusable candle of claim 1 wherein the cup comprises:

a flange around a periphery of said cup for enabling said cup to be supported by a portion of said insulating layer.

9. The reusable candle of claim 8, wherein:

removable inserts of varying height may be used with said permanent structure.

10. The reusable candle of claim 8, wherein:

removable inserts may be attached to said insulating layer at a range of vertical positions with respect to a top of said outer shell.

11. The reusable candle of claim 1 wherein a space below said insert, when said insert is in position within the sleeve and the outer shell, within said sleeve is empty.

12. The reusable candle of claim 1 wherein all components of said candle are of cylindrical cross-sectional geometry.

13. The reusable candle of claim 1 wherein said outer shell includes potpourri for providing decoration and odor to said candle.

14. The reusable candle of claim 1 wherein said outer shell is made of wax.

15. A method for manufacturing an insert for use in a reusable candle, the method comprising the steps of:

securing a first end of at least one wick to a disk, wherein said at least one wick has a second end;

inserting a plastic disk into a cup such that the disk fits snugly to an interior diameter of said cup, wherein an outside diameter of said disk substantially matches an inside diameter of said cup;

securing the cup such that an open surface of said cup is substantially horizontal;

holding the second end of said at least one wick such that said at least one wick is substantially straight and vertical; and pouring molten wax into said cup, wherein said molten wax is permitted to solidify while said cup, said disk, and said at least one wick are substantially undisturbed.

16. The method of claim 15, wherein one wick is adhered to a point on the disk substantially centered on a surface of said disk.

17. The method of claim 15, wherein the disk is made of polytetrafluoroethylene.

18. The method of claim 15, wherein the cup is made of plastic.

19. The method of claim 15, wherein the cup is made of polycarbonate.

20. The method of claim 15, wherein the disk is placed flush against a base of said cup.

21. The method of claim 15, wherein the disk is located a finite distance away from, and oriented substantially parallel to a base of said cup.

22. The method of claim 21, wherein the disk forms a wax-tight seal with the interior diameter of said cup thereby preventing wax from seeping below said disk during said step of pouring.

23. An insert for use with a reusable candle, the insert comprising:

a cup made of thermally resilient plastic suitable for easy insertion into and removal from an external structure;

a plastic disk placed within said cup in a substantially horizontal orientation, wherein an outside diameter of said disk substantially matches an inside diameter of said cup;

wax substantially filling a volume bounded by an upper surface of said disk and a top of said cup; and at least one wick affixed to said plastic disk, wherein said at least one wick is substantially straight and runs from a point of attachment on said disk to a point slightly above an upper surface of said wax, thereby forming an insert with contents combustible independently of said external structure.

24. The insert of claim 23, wherein said cup is made of polycarbonate.

25. The insert of claim 23, wherein said disk is made of polytetrafluoroethylene.

26. The insert of claim 23, wherein said disk is flush against a base of said cup.

27. The insert of claim 23, wherein said disk is secured to said cup a finite distance away from a base of said cup and substantially parallel to said base.

28. The insert of claim 23, wherein said cup comprises:

a flange completely encircling a perimeter of said cup to enable said cup to be supported on a surface on said external structure.

* * * * *